US011282426B2

(12) United States Patent
Park et al.

(10) Patent No.: US 11,282,426 B2
(45) Date of Patent: Mar. 22, 2022

(54) DISPLAY DEVICE HAVING A SWITCH UNIT FOR POWER SWITCHING OPERATION AND METHOD OF DRIVING THE SAME

(71) Applicant: Samsung Display Co., Ltd., Yongin-si (KR)

(72) Inventors: Jae Cheon Park, Yongin-si (KR); Seung Kyu Lee, Yongin-si (KR); Yoon Gyu Lee, Yongin-si (KR); Chae Han Hyun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/868,837

(22) Filed: May 7, 2020

(65) Prior Publication Data

US 2020/0357320 A1 Nov. 12, 2020

(30) Foreign Application Priority Data

May 8, 2019 (KR) ..... 10-2019-0053927

(51) Int. Cl.
*G09G 3/32* (2016.01)
*G09G 3/20* (2006.01)

(52) U.S. Cl.
CPC ..... *G09G 3/20* (2013.01); *G09G 2310/0267* (2013.01); *G09G 2310/0272* (2013.01); *G09G 2310/0291* (2013.01); *G09G 2310/08* (2013.01)

(58) Field of Classification Search
CPC ..... G09G 3/20
USPC ..... 345/214
See application file for complete search history.

(56) References Cited

U.S. PATENT DOCUMENTS

| | | | | |
|---|---|---|---|---|
| 8,723,851 | B2 | 5/2014 | Choe | |
| 9,722,554 | B2 | 8/2017 | Higuchi | |
| 2007/0001978 | A1* | 1/2007 | Cho | G09G 3/3655 345/98 |
| 2012/0032935 | A1* | 2/2012 | Yen | G09G 3/20 345/211 |

(Continued)

FOREIGN PATENT DOCUMENTS

| | | |
|---|---|---|
| JP | 6370647 | 8/2018 |
| KR | 10-2007-0118340 | 12/2007 |
| KR | 10-2015-0127500 | 11/2015 |

*Primary Examiner* — Long D Pham
(74) *Attorney, Agent, or Firm* — H.C. Park & Associates, PLC

(57) ABSTRACT

A display device, including: pixels coupled to scan lines and data lines; a data driver configured to supply respective data signals to the data lines, including an amplifier disposed at an output terminal of the data driver, the amplifier including a first power terminal and a second power terminal; a switch unit configured to perform a power switching operation of alternately connecting the first power terminal and the second power terminal of the amplifier to a first driving power source and a second driving power source; and a driving controller configured to control the data driver and the switch unit, wherein the driving controller is configured to output a switch control signal to control the switch unit and interrupt the power switching operation during a blank period between source output periods, during which the data driver is configured to output the data signals of each frame.

16 Claims, 8 Drawing Sheets

(56) References Cited

U.S. PATENT DOCUMENTS

2014/0306872 A1* 10/2014 Yun ..... G09G 3/3688
345/99
2014/0347297 A1* 11/2014 Tsuji ..... G06F 3/04184
345/173
2015/0325200 A1 11/2015 Rho et al.

* cited by examiner

FIG. 6

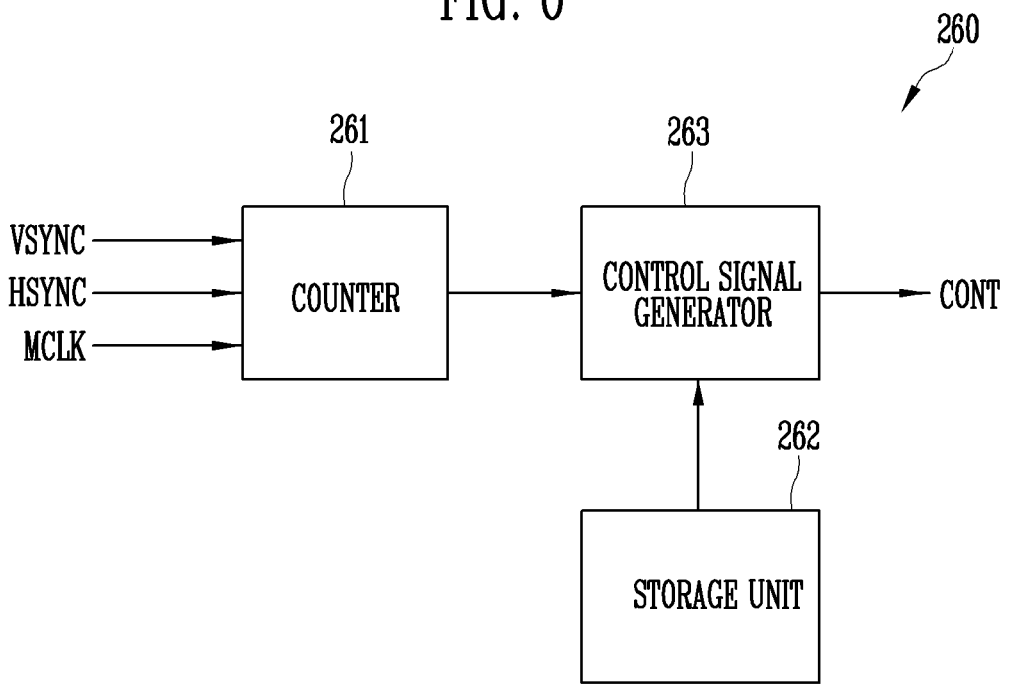

FIG. 7

| Name | Description |
|---|---|
| CHOP_CON_NOM | Source amp chopping timing control register in normal mode |
| CHOP_CON_LFM | Source amp chopping timing control register in low frequency mode |
| CHOP_CON_HFM | Source amp chopping timing control register in high frequency mode |
| CHOP_EN | Source amp chopping on/off signal |
| COLUM_CHOP | Source amp column chopping control signal |
| FRAME_CHOP | Source amp frame chopping control signal |
| LINE_CHOP | Source amp line chopping control signal |

FIG. 8

| Name | Description |
|---|---|
| CHOP_CON_NOM | Source amp chopping timing control register in normal mode |
| CHOP_CON_LFM | Source amp chopping timing control register in low frequency mode |
| CHOP_CON_HFM | Source amp chopping timing control register in high frequency mode |
| CHOP_EN | Source amp chopping on/off signal |
| COLUM_CHOP | Source amp column chopping control signal |
| FRAME_CHOP | Source amp frame chopping control signal |
| LINE_CHOP | Source amp line chopping control signal |
| CHOP_BLK_EN | Source amp chopping on/off signal in VBLANK section |
| CHOP_BLK_OFF_ST | Set the starting point of source chopping off in VBLANK section |
| CHOP_BLK_OFF_END | Set the end point of source chopping off in VBLANK section |

DISPLAY DEVICE HAVING A SWITCH UNIT FOR POWER SWITCHING OPERATION AND METHOD OF DRIVING THE SAME

CROSS-REFERENCE TO RELATED APPLICATION

The present application claims priority to Korean patent application number 10-2019-0053927 filed on May 8, 2019, the entire disclosure of which is incorporated herein in its entirety by reference.

BACKGROUND

Field

Exemplary embodiments/implementations of the invention relate generally to a display device and a method of driving the display device.

Discussion of the Background

A display device includes pixels disposed in a display area, and a scan driver and a data driver for driving the pixels. The scan driver generates a scan signal for sequentially selecting pixels of each horizontal line during each frame period. The data driver generates data signals corresponding to the pixels selected by the scan signal.

The data driver generates a data signal in response to image data and a data control signal. The data signal is amplified using an amplifier placed at the output terminal of each channel, and the data driver outputs the amplified data signal. Because the amplifier has its offset, the data signal output from the data driver may have a voltage deviation caused by the offset of the amplifier.

The above information disclosed in this Background section is only for understanding of the background of the inventive concepts, and, therefore, it may contain information that does not constitute prior art.

SUMMARY

Devices constructed and methods according to exemplary embodiments of the invention are capable of providing a display device and a method of driving the display device, which may reduce the voltage deviation of a data signal by cancelling out the offset of an amplifier and efficiently control a power switching period for the reduction of the voltage deviation.

Additional features of the inventive concepts will be set forth in the description which follows, and in part will be apparent from the description, or may be learned by practice of the inventive concepts.

According to one or more exemplary embodiments of the invention, a display device, includes: a display unit including pixels coupled to scan lines and data lines; a scan driver configured to supply respective scan signals to the scan lines; a data driver configured to supply respective data signals to the data lines, the data driver including an amplifier disposed at an output terminal of the data driver, the amplifier including a first power terminal and a second power terminal; a switch unit configured to perform a power switching operation of alternately connecting the first power terminal and the second power terminal of the amplifier to a first driving power source and a second driving power source; and a driving controller configured to control the scan driver, the data driver, and the switch unit in response to input image data and a timing signal, wherein the driving controller is configured to output a switch control signal to control the switch unit, wherein the switch unit is configured to interrupt the power switching operation in response to receiving the switch control signal during a blank period, the blank period being arranged between source output periods, and wherein the data driver is configured to output the data signals of each frame during the source output periods.

The driving controller may be configured to control the switch unit to perform the power switching operation during the source output periods.

The switch unit may include: a first switch configured to alternately connect the first power terminal of the amplifier to the first driving power source and the second driving power source in response to the switch control signal in the source output periods; and a second switch configured to alternately connect the second power terminal of the amplifier to the first driving power source and the second power driving source in an order inverse to the first switch in response to the switch control signal in the source output periods.

In response to the switch control signal, the first switch and the second switch may be configured to repeatedly perform the power switching operation at every predetermined period during the source output periods.

In response to the switch control signal, the first switch and the second switch may be configured to interrupt the power switching operation or maintain a turn-off state during the blank period.

The driving controller may include a switch controller configured to generate the switch control signal using the timing signal.

The switch controller may include: a counter configured to detect the blank period by counting the timing signal; a storage unit configured to store an option for the power switching operation of the switch unit; and a control signal generator configured to generate the switch control signal based on the blank period detected by the counter, and the option for the power switching operation extracted from the storage unit.

The option for the power switching operation includes at least one of a driving mode of the display device, a power switching operation mode, and a period of the power switching operation.

The option for the power switching operation may further include at least one of a power switching operation mode during the blank period and information about a section of the blank period during which the power switching operation is interrupted.

The blank period may include a front porch period and a back porch period that may be successively arranged between the source output periods.

The data driver may include amplifiers disposed in respective output channels coupled to the respective data lines, and the switch unit may be configured to: connect first power terminals of at least one of the amplifiers to one of the first and second driving power sources for a first predetermined time period; and connect second power terminals of the at least one of the amplifiers to a remaining one of the first and second driving power sources for a second predetermined time period.

The display device may further include a sensor unit that overlaps the display unit, and the driving controller may be configured to drive the sensor unit during the blank period.

According to one or more exemplary embodiments of the invention, a method of driving a display device, includes: generating a switch control signal in response to a timing signal; and outputting a data signal of each frame; performing, while outputting the data signal, a power switching operation by alternately switching connections from a first power terminal and a second power terminal of an amplifier disposed at an output terminal of a data driver, to a first driving power source and a second driving power source in response to the switch control signal, wherein the power switching operation is repeatedly performed during source output periods, the source output periods referring to time frame in which the data signal of each frame is output, and wherein the power switching operation is interrupted during a blank period, the blank period arranged between the source output periods.

Generating the switch control signal may include: detecting the blank period based on the timing signal; and generating the switch control signal based on the blank period and a power switching operation option that may be pre-stored.

The power switching operation option may include at least one of a driving mode of the display device, a power switching operation mode, and a period at which the power switching operation may be performed.

The power switching operation option further may include at least one of a power switching operation mode during the blank period and information about a section of the blank period during which the power switching operation may be interrupted.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 6 illustrates a switch controller according to an exemplary embodiment of the present disclosure.

FIG. 7 and FIG. 8 illustrate examples of a source chopping option stored in the storage unit of FIG. 6.

DETAILED DESCRIPTION

Figure 1:
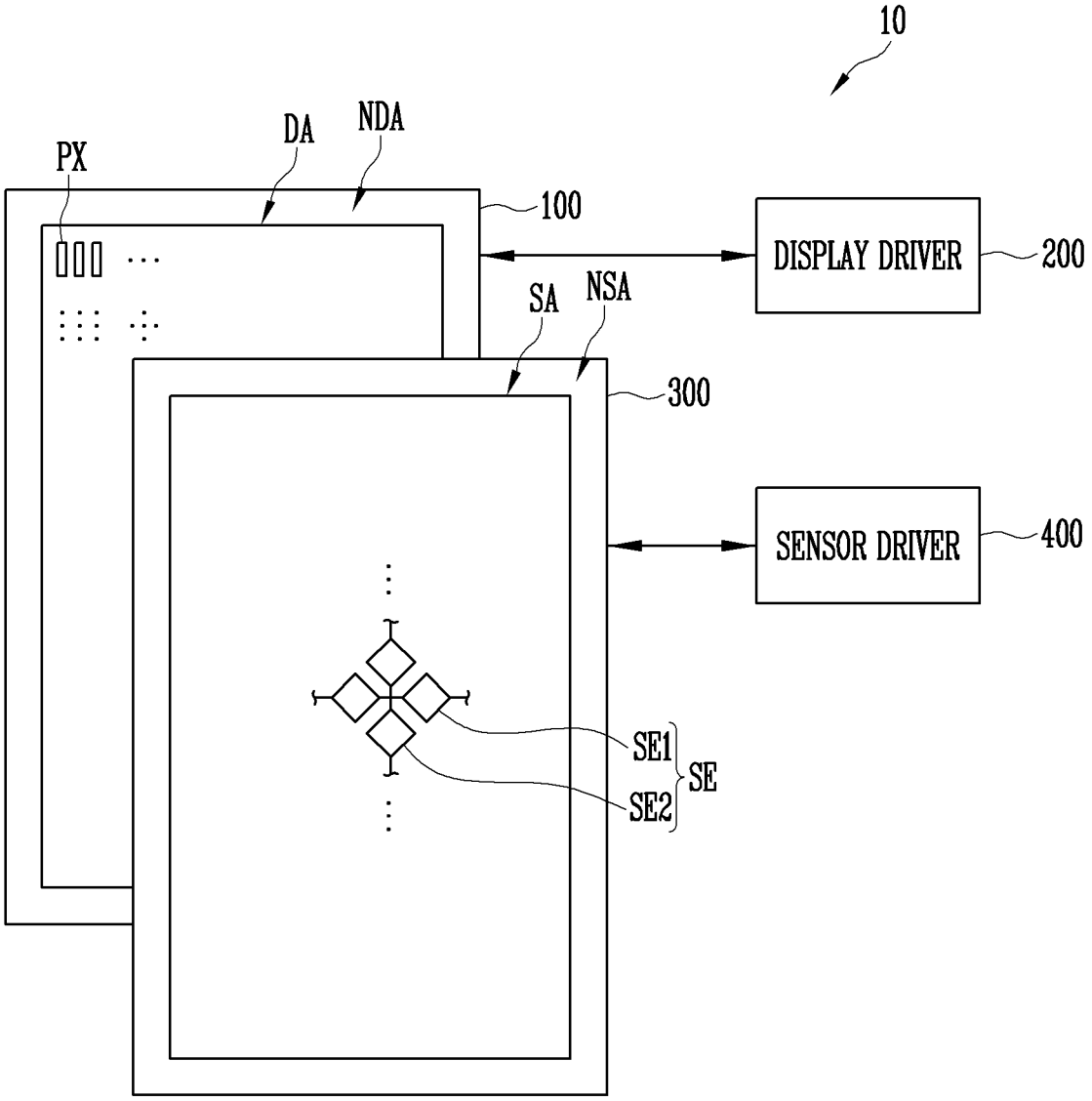
FIG. 1 illustrates a display device according to an exemplary embodiment of the present disclosure.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 illustrates a display device 10 according to an exemplary embodiment of the present disclosure. According to an exemplary embodiment, FIG. 1 discloses the display device 10 including a touch sensor, but the display device 10 according to the present disclosure is not limited thereto.

Referring to FIG. 1, the display device 10 according to an exemplary embodiment of the present disclosure may include a display unit 100 configured to display an image, a display driver 200 configured to drive the display unit 100, a sensor unit 300 configured to sense touch input, and a sensor driver 400 configured to drive the sensor unit 300. The display unit 100 and the sensor unit 300 may form the panel unit of the display device 10, and the display driver 200 and the sensor driver 400 may form the driver unit of the display device 10. In an exemplary embodiment, the sensor unit 300 and the sensor driver 400 may form a touch sensor configured to detect touch input that is input to the panel unit of the display device 10.

According to an exemplary embodiment, the display unit 100 and the sensor unit 300 may be produced so as to form a single unit, or may be combined using an adhesive layer or the like after they are separately produced. Also, the display driver 200 and the sensor driver 400 may be separate from each other, or at least one portion of the display driver 200 and at least one portion of the sensor driver 400 may be integrated into a single integrated chip (driver IC) together.

The display unit 100 includes a display area DA and a non-display area NDA, which surrounds the display area DA. The display area DA is an area that forms the screen of the display device 10, and the pixels PX are disposed in the display area DA. The non-display area NDA is a remaining area, excluding the display area DA, and may be, for example, an edge area that surrounds the screen. In the non-display area NDA, lines coupled to the pixels PX and/or at least one driving circuit for driving the pixels PX may be disposed.

In an exemplary embodiment, the display unit 100 may be a display panel capable of emitting light by itself or a non-emissive display panel. For example, the display unit 100 may be configured as a display panel capable of emitting light by itself, in which case each of the pixels PX includes one or more organic/inorganic light-emitting elements, or may be configured as a non-emissive display panel, such as a Liquid Crystal Display (LCD) panel. When the display unit 100 is a non-emissive display panel, the display device 10 may further include a light source unit (e.g., a backlight unit) for supplying light to the display unit 100.

The display driver 200 drives the pixels PX in response to image data and timing signals input from the outside. To this end, the display driver 200 is electrically coupled to the display unit 100, thereby supplying the display unit 100 with signals, which are necessary for driving the pixels PX. The display driver 200 may include a scan driver and a data driver, which are configured to supply respective scan signals and data signals to the pixels PX, and a driving controller (e.g., a timing controller) configured to control the scan driver and the data driver. According to an exemplary embodiment, the scan driver, the data driver, and/or the driving controller may be integrated into a single display driver integrated chip (IC), but the configurations thereof are not limited thereto. For example, in another exemplary embodiment, at least one (or at least some) of the scan driver, the data driver, and the driving controller may be disposed in the non-display area NDA of the display unit 100.

The sensor unit 300 (or referred to as a "sensing unit") includes a sensing area SA and a non-sensing area NSA, which surrounds the sensing area SA. The sensing area SA is an area in which touch input by a user may be sensed, and sensor electrodes SE may be disposed in the sensing area SA. The non-sensing area NSA is a remaining area, excluding the sensing area SA, and may be, for example, a peripheral area or an edge area in the vicinity of the sensing area SA. In the non-sensing area NSA, lines coupled to the sensor electrodes SE may be disposed.

According to an exemplary embodiment, the sensor unit 300 may overlap the display unit 100. For example, the sensing area SA may be disposed so as to overlap the display area DA, and the sensor electrodes SE may be disposed above and/or below the pixels PX so as to overlap the pixels PX.

In an exemplary embodiment, the sensor unit 300 may be a capacitive sensor unit. For example, the sensor unit 300 may be a mutual capacitive sensor unit, which includes first sensor electrodes SE1 and second sensor electrodes SE2, which extend so as to intersect with each other in the sensing area SA. According to an exemplary embodiment, either the first sensor electrodes SE1 or the second sensor electrodes SE2 may be driving electrodes (referred to as "Tx electrodes"), which are supplied with driving signals during a predetermined touch sensing period, and the other ones may be sensing electrodes (referred to as "Rx electrodes"), which output sensing signals corresponding to the driving signals.

However, in the present disclosure, the structure, the type, and/or the driving method of the sensor unit 300 are not limited to specific ones. For example, the sensor unit 300 may be configured as a self-capacitive sensor unit, including dot-type sensor electrodes individually distributed in the sensing area SA. Additionally, the sensor unit 300 may include sensor electrodes having various structures, types and driving methods, which are currently known. Also, FIG. 1 discloses an exemplary embodiment in which the display device 10 includes a touch sensor, but the present disclosure is not limited thereto. For example, the display device 10 may optionally include various types of sensors that are currently known.

The sensor driver 400 is electrically coupled to the sensor unit 300, thereby transmitting/receiving signals that are necessary for driving the sensor unit 300. For example, the sensor driver 400 may supply a driving signal to the sensor unit 300 during a predetermined touch sensing period and detect touch input by receiving a sensing signal, corresponding to the driving signal, from the sensor unit 300.

The sensor driver 400 may include a sensor driving circuit and a sensing circuit. According to an exemplary embodiment, the sensor driving circuit and the sensing circuit may be integrated into a single sensor IC (e.g., a touch IC), but the configurations thereof are not limited thereto. Also, according to an exemplary embodiment, the sensor driver 400 may be integrated into a single driver IC along with the display driver 200, but the configuration thereof is not limited thereto.

According to an exemplary embodiment, the sensor driving circuit is electrically coupled to the driving electrodes (e.g., the first sensor electrodes SE1) of the sensor unit 300, thereby sequentially supplying driving signals to the driving electrodes during a predetermined touch sensing period. According to an exemplary embodiment, the sensing circuit is electrically coupled to the sensing electrodes (e.g., the second sensor electrodes SE2) of the sensor unit 300, thereby detecting touch input using the sensing signals output from the respective sensing electrodes.

In an exemplary embodiment, the sensor unit 300 may be driven in a blank period, which is arranged between source output periods. The source output periods may be respective active periods in which the display driver 200 outputs data signals of each frame to the display unit 100. Also, the blank period may be a period arranged between the active periods, and may be, for example, a vertical blank period.

The above-described display device 10 includes a touch sensor, thereby providing user convenience. For example, a user may easily control the display device 10 by touching a screen while viewing an image displayed in the display area DA.

Figure 2:
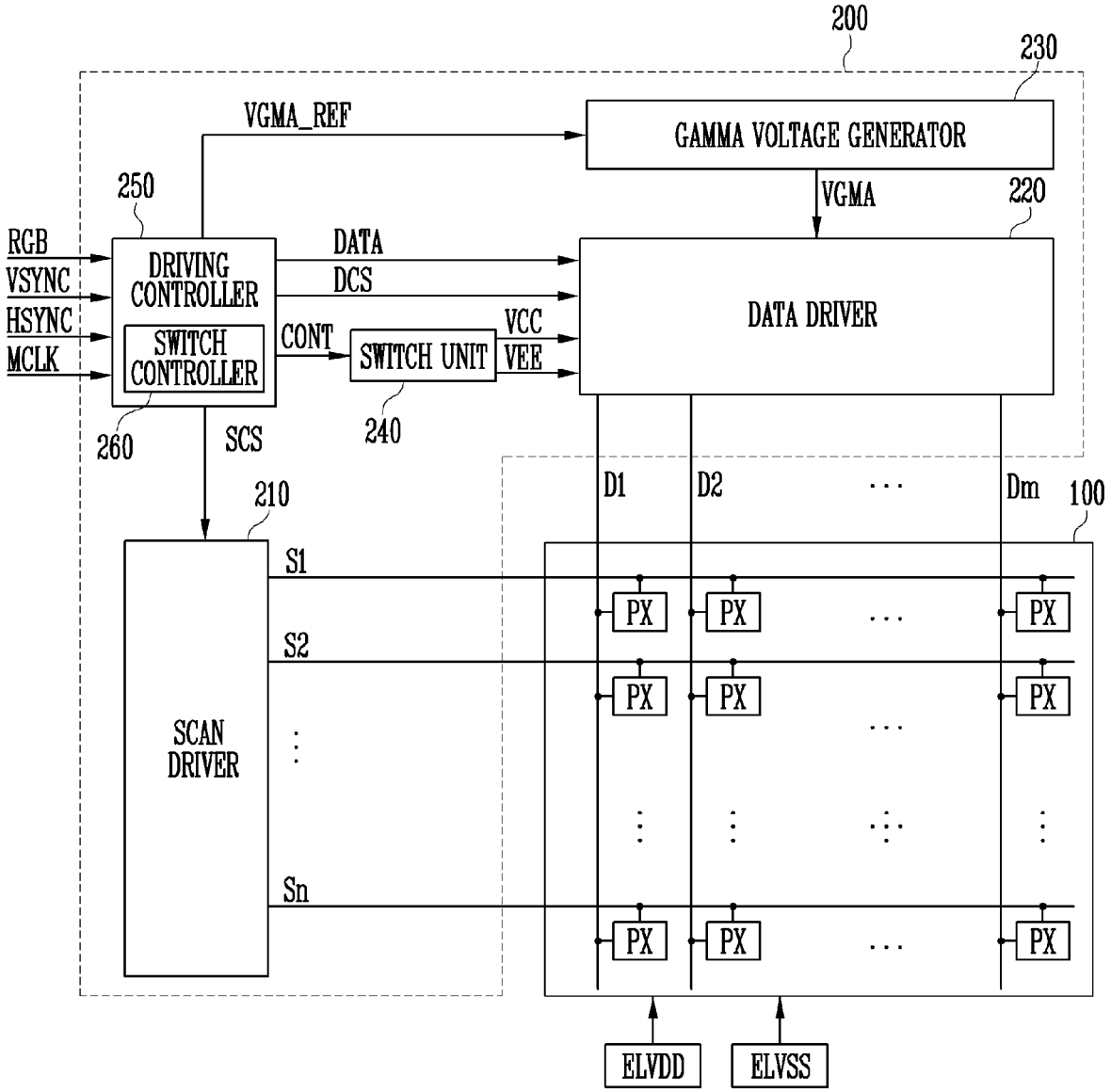
FIG. 2 illustrates a display unit and a display driver according to an exemplary embodiment of the present disclosure.

FIG. 2 illustrates the display unit 100 and the display driver 200 according to an exemplary embodiment of the present disclosure.

Referring to FIG. 2, the display unit 100 includes scan lines S1 to Sn, data lines D1 to Dm, and pixels PX coupled to the scan lines S1 to Sn and the data lines D1 to Dm. Also, depending on the structure and the driving method of the pixels PX, at least one type of control lines may be further disposed in the display unit 100. For example, the display unit 100 may further include emission control lines, which are coupled to the pixels PX in units of horizontal lines by being disposed in parallel with the scan lines S1 to Sn.

When an exemplary embodiment of the present disclosure is described, "coupling" may comprehensively mean "coupling or connecting" in physical and/or electrical aspects. For example, the pixels PX may be electrically coupled to the scan lines S1 to Sn and the data lines D1 to Dm.

The scan lines S1 to Sn are coupled between the scan driver 210 and the pixels PX. The scan lines S1 to Sn transmit scan signals output from the scan driver 210 to the pixels PX. The scan signals control the timing at which data signals are input to the respective pixels PX. For example, in response to each scan signal, the pixels PX of any one horizontal line are selected, and the selected pixels PX may be supplied with data signals from the data lines D1 to Dm.

The data lines D1 to Dm are coupled between the data driver 220 and the pixels PX. The data lines D1 to Dm transmit data signals output from the data driver 220 to the pixels PX. Depending on the data signals, whether each of the pixels PX emits light and the luminance of the light may be controlled.

The pixels PX are supplied with the scan signals and the data signals respectively from the scan lines S1 to Sn and the data lines D1 to Dm. Also, the pixels PX may be supplied with pixel power from a power supply unit (not illustrated). For example, when the display unit 100 is a light-emitting display panel, the pixels PX may be supplied with power from a first pixel power source ELVDD and a second pixel power source ELVSS, which have different electric potentials. For example, the first pixel power source ELVDD and the second pixel power source ELVSS may have different electric potentials such that the difference thereof enables the light-emitting element of each of the pixels PX to emit light during the emission period of each of the pixels PX.

Each of the pixels PX emits light having the luminance corresponding to a data signal during the emission period thereof. Meanwhile, when a data signal corresponding to a black grayscale is supplied to each of the pixels PX, the each of the pixels PX may maintain a non-emissive state during the emission period of the corresponding frame.

In an exemplary embodiment, the pixels PX may be self-emissive pixels including their own light-emitting elements, but the pixels PX are not limited thereto. That is, the type, the structure, and/or the driving method of the pixels PX may be variously changed according to an exemplary embodiment.

The display driver 200 drives the pixels PX in response to input image data RGB and timing signals. The display driver 200 may include the scan driver 210, the data driver 220, a gamma voltage generator 230, a switch unit 240, and a driving controller 250 configured to control the scan driver 210, the data driver 220, the gamma voltage generator 230, and the switch unit 240. In an exemplary embodiment, the scan driver 210, the data driver 220, the gamma voltage generator 230, the switch unit 240, and/or the driving controller 250 may be integrated into a single driver IC, but the configurations thereof are not limited thereto.

The scan driver 210 is supplied with a scan control signal SCS from the driving controller 250 and supplies respective scan signals to the scan lines S1 to Sn in response to the scan control signal SCS. For example, the scan driver 210 may be supplied with a scan control signal SCS, which includes a gate start pulse (e.g., a sampling pulse input to a first scan stage) and a gate clock signal and sequentially output scan signals having a gate-on voltage to the scan lines S1 to Sn in response thereto. When the pixels PX are selected in units of horizontal lines by the respective scan signals, the selected pixels PX are supplied with data signals of the corresponding frame from the data lines D1 to Dm. According to an exemplary embodiment, the scan driver 210 may be formed inside a driver IC or the like, or may be formed or mounted on the display panel along with the pixels PX.

The data driver 220 may be supplied with image data DATA and a data control signal DCS from the driving controller 250, and may be supplied with gamma voltages VGMA for respective grayscales from the gamma voltage generator 230. The data driver 220 generates respective data signals using the image data DATA, the data control signal DCS, and the gamma voltages VGMA and supplies the respective data signals to the data lines D1 to Dm. For example, the data driver 220 may be supplied with the image data DATA, the gamma voltages VGMA, and the data control signal DCS, which includes a source start pulse SSP, a source sampling clock SSC, a source output enable signal SOE, and the like. For each horizontal period, the data driver 220 may output respective data signals, corresponding to the pixels PX selected for the corresponding horizontal period, to the data lines D1 to Dm. According to an exemplary embodiment, the data driver 220 may be formed inside a driver IC or the like, or may be formed or mounted on the display panel along with the pixels PX.

The gamma voltage generator 230 is supplied with reference gamma voltages VGMA_REF for predetermined reference grayscales from the driving controller 250 and generates gamma voltages VGMA for respective grayscales for converting the image data DATA in a digital form into a data signal (e.g., a data voltage) in an analog form using the reference gamma voltages VGMA_REF. For example, when the display device represents grayscales from 0 to 255, the gamma voltage generator 230 may generate grayscale voltages corresponding to a predetermined gamma value, for example, 2.2 gamma, based on the reference gamma voltages VGMA_REF and then supply the same to the data driver 220.

The switch unit 240 is supplied with a switch control signal CONT (referred to as a "chopping control signal") from the driving controller 250 and supplies power from a first driving power source VCC and a second driving power source VEE to the data driver 220 in response to the switch control signal CONT. The first driving power source VCC and the second driving power source VEE may supply operating power of an amplifier that forms each output buffer of the data driver 220. In an exemplary embodiment, the switch unit 240 may alternately supply the first driving power and the second driving power to the first power terminal and the second power terminal of the amplifier disposed at each output terminal of the data driver 220 through power switching (referred to as "power chopping", "source chopping", or "source amp chopping").

The driving controller 250 is supplied with input image data RGB and timing signals from the outside (e.g., a host processor) and controls the operations of the scan driver 210, the data driver 220, and the switch unit 240 in response to the input image data RGB and the timing signals. For example, the driving controller 250 may be supplied with timing signals, including a vertical synchronization signal VSYNC, a horizontal synchronization signal HSYNC, a main clock signal MCLK, and the like, and generate a scan control signal SCS, a data control signal DCS, and a switch control signal CONT in response thereto. The scan control signal SCS, the data control signal DCS, and the switch control signal CONT are supplied to the scan driver 210, the data driver 220, and the switch unit 240, respectively.

Also, the driving controller 250 may rearrange the input image data RGB depending on the specification and/or the driving mode of the display unit 100 and output the rearranged image data DATA to the data driver 220. The image data DATA supplied to the data driver 220 is used to generate a data signal.

Additionally, the driving controller 250 may supply reference gamma voltages VGMA_REF, which are stored depending on a gamma configuration, to the gamma voltage generator 230. For example, the driving controller 250 may supply the reference gamma voltages VGMA_REF, stored in the internal memory, to the gamma voltage generator 230 through a multi-time programming (MTP) process or the like. The reference gamma voltages VGMA_REF may be used to generate gamma voltages VGMA for respective grayscales. According to an exemplary embodiment, the driving controller 250 may be configured as a timing controller or an integrated controller including the timing controller.

In an exemplary embodiment of the present disclosure, the driving controller 250 controls power switching, which is performed by the switch unit 240. To this end, the driving controller 250 may include a switch controller 260.

For example, the driving controller 250 (e.g., the switch controller 260 in the driving controller 250) may detect each blank period using a timing signal and output a switch control signal CONT for interrupting the power switching operation of the switch unit 240 (e.g., turning off the switch) during the blank period. For example, the driving controller 250 may output a switch control signal CONT (e.g., a switch control signal CONT having an 'off' level) for interrupting the power switching operation of the switch unit 240 in response to each blank period. According to an exemplary embodiment, the blank period may be a vertical blank period arranged between source output periods in which data signals of each frame are output.

Meanwhile, the driving controller 250 may output a switch control signal CONT (e.g., a switch control signal having an 'on' level) for enabling the power switching operation of the switch unit 240 in source output periods in which valid data signals are output from the data driver 220.

That is, in an exemplary embodiment of the present disclosure, the power switching operation of the switch unit 240 is performed in the source output periods in which valid data signals are output, but may be temporarily interrupted in each blank period that is inserted between the source output periods.

The display device including the display driver 200 according to the above-described embodiment (e.g., the display device 10 of FIG. 1) may alternately supply power from a first driving power source VCC and a second driving power source VEE to the first power terminal and the second power terminal of an amplifier disposed at each output terminal of the data driver 220 through repeated power switching. For example, over a period during which a power switching operation is enabled by a switch control signal CONT (e.g., a source output period of each frame), the first driving power source VCC and the second driving power source VEE may supply power to the first power terminal and the second power terminal of the amplifier, respectively, during a first period, and then the second driving power source VEE and the first driving power source VCC may supply power to the first power terminal and the second power terminal of the amplifier, respectively, during a second period that follows the first period. The above-described process may be repeated at every predetermined period while the power switching operation is enabled. When this power switching method is applied, the offset of the amplifier is canceled out, whereby the voltage deviation of a data signal, output from the data driver 220, may be prevented or reduced. Also, with the application of the power switching method, the deterioration of the amplifier may be prevented or reduced.

Additionally, in an exemplary embodiment of the present disclosure, a switch control signal CONT may be generated so as to enable a power switching operation by driving the switch unit 240 in periods in which the data driver 220 outputs a valid data signal, that is, in the source output periods, and so as to temporarily interrupt the operation of the switch unit 240 in a period excluding the source output periods, that is, in each blank period inserted between the source output periods. According to this embodiment of the present disclosure, the switching period of the operating power supplied to the output buffer unit of the data driver 220 may be efficiently controlled using the switching control signal CONT. For example, in the state in which a power switching operation is temporarily interrupted during at least one blank period using a switch control signal CONT, a sensor unit (e.g., the sensor unit 300 in FIG. 1) may be driven. In this case, voltage variation of the sensor electrodes SE, which is caused by power switching, is prevented or reduced, whereby the noise of the sensor unit 300 may be effectively reduced.

Figure 3:
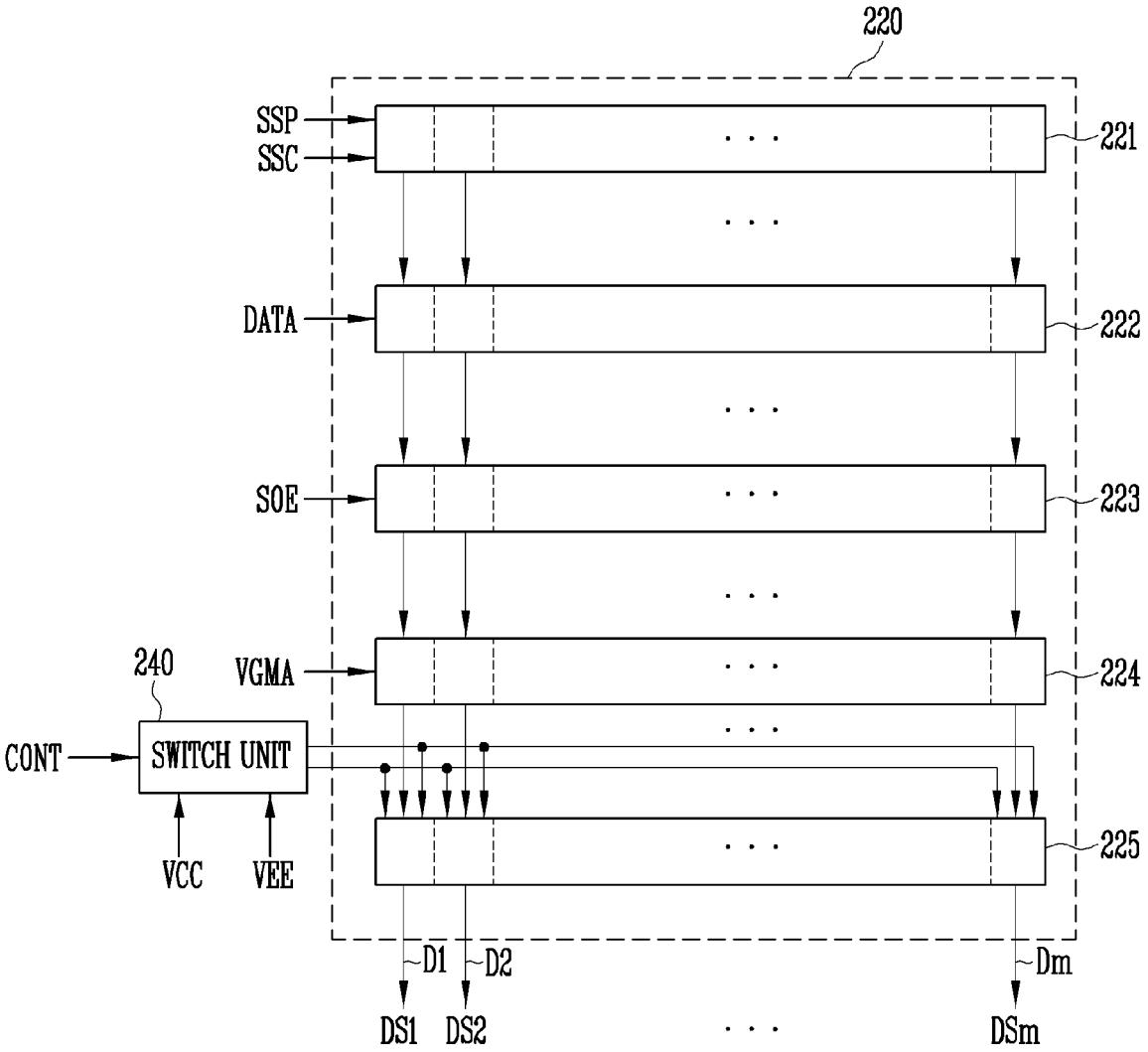
FIG. 3 illustrates a data driver according to an exemplary embodiment of the present disclosure.

FIG. 3 illustrates the data driver 220 according to an exemplary embodiment of the present disclosure.

Referring to FIG. 3, the data driver 220 according to an exemplary embodiment of the present disclosure may include a shift register unit 221, a sampling latch unit 222, a holding latch unit 223, a data signal generation unit 224, and an output buffer unit 225. Here, the shift register unit 221, the sampling latch unit 222, and the holding latch unit 223 may form the input unit of the data driver 220, and the output buffer unit 225 may form the output unit of the data driver 220.

The shift register unit 221 may be supplied with a source start pulse SSP and a source sampling clock SSC from the driving controller 250. The shift register unit 221 may sequentially generate a sampling pulse by shifting the source start pulse SSP for each period of the source sampling clock SSC. To this end, the shift register unit 221 may include multiple shift registers that are disposed in respective channels. For example, the shift register unit 221 may include m shift registers that correspond to the data lines D1 to Dm, respectively.

The sampling latch unit 222 may sequentially store image data DATA supplied from the driving controller 250 in response to the sampling pulse sequentially supplied from the shift register unit 221. To this end, the sampling latch unit 222 may include multiple sampling latches that are disposed in the respective channels. For example, the sampling latch unit 222 may include m sampling latches that correspond to the data lines D1 to Dm, respectively.

The holding latch unit 223 may be supplied with a source output enable signal SOE from the driving controller 250. The holding latch unit 223 may be supplied with image data DATA from the sampling latch unit 222 and store the same when the source output enable signal SOE is input. For example, the holding latch unit 223 may be simultaneously supplied with image data DATA for one horizontal line (e.g., line data) from the sampling latch unit 222 in response to the source output enable signal SOE. Also, when the source output enable signal SOE is input, the holding latch unit 223 may supply the image data DATA stored therein to the data signal generation unit 224. To this end, the holding latch unit 223 may include multiple holding latches that are disposed in the respective channels. For example, the holding latch unit 223 may include m holding latches that correspond to the data lines D1 to Dm, respectively.

Meanwhile, in FIG. 3, the input unit of the data driver 220 is configured with the shift register unit 221, the sampling latch unit 222, and the holding latch unit 223, but the present disclosure is not limited thereto. For example, various components that are currently known may be additionally included in the input unit.

The data signal generation unit 224 may generate a data signal (or referred to as a "data voltage") in an analog form using the image data DATA in a digital form, which is supplied from the input unit. To this end, the data signal generation unit 224 may include multiple digital-to-analog converters that are disposed in the respective channels. Each of the digital-to-analog converters may select any one of gamma voltages VGMA in response to the image data DATA supplied from the input unit and supply the selected gamma voltages VGMA to each channel of the output buffer unit 225 as a data signal. For example, for each horizontal period, the first digital-to-analog converter in the first channel of the data signal generation unit 224 may generate a data signal corresponding to the data DATA of the first pixel PX of the corresponding horizontal line and supply the data signal to the first output buffer in the first channel of the output buffer unit 225. Hereinafter, the data signal output from the data signal generation unit 224 is referred to as a "data voltage" so as to be differentiated from the data signals DS1 to DSm finally output to the data lines D1 to Dm via the output buffer unit 225.

The output buffer unit 225 amplifies the data voltages supplied from the data signal generation unit 224 and supplies the same to the respective data lines D1 to Dm. To this end, the output buffer unit 225 may include multiple output buffers disposed in the respective channels of the data driver 220. For example, the output buffer unit 225 may include multiple output buffers disposed in the respective output channels so as to be coupled to the respective data lines D1 to Dm. Each of the output buffers may include an amplifier. That is, the data driver 220 may include multiple amplifiers disposed at the output terminal of the data driver 220 so as to be coupled to the respective data lines D1 to Dm.

The amplifiers may amplify data voltages supplied from the respective digital-to-analog converters and output the amplified data voltages to the data lines D1 to Dm as data signals DS1 to DSm. That is, each of the amplifiers may be driven by receiving a data voltage supplied from each of the digital-to-analog converters as an input signal. Also, the amplifiers may be driven using power, which is supplied from the first driving power source VCC and the second driving power source VEE and delivered via the switch unit 240, as operating power.

Figure 4:
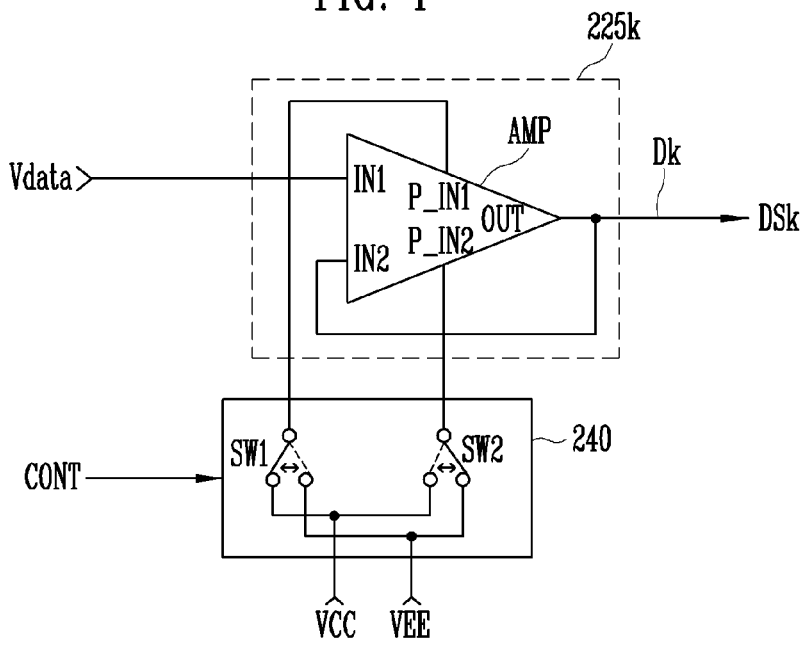
FIG. 4 illustrates an output buffer included in the output buffer unit of FIG. 3 and a switch unit coupled thereto.

FIG. 4 illustrates the output buffer 225*k* included in the output buffer unit 225 of FIG. 3 and the switch unit 240 coupled thereto. According to an exemplary embodiment, FIG. 4 illustrates the output buffer 225*k* that is disposed in the k-th channel (k is a natural number), among multiple output buffers disposed at the output terminal of the data driver 220, and the multiple output buffers disposed at the output terminal of the data driver 220 may have similar structures or the same structure.

Referring to FIG. 4, each output buffer 225*k* is supplied with a data voltage Vdata from a corresponding one of the digital-to-analog converters, amplifies the data voltage Vdata, and outputs the amplified data voltage Vdata to each data line Dk as a data signal DSk. To this end, the output buffer 225*k* may include an amplifier (referred to as a "source amp") AMP. The amplifier AMP may include a first input terminal IN1, a second input terminal IN2, a first power terminal P_IN1, a second power terminal P_IN2, and an output terminal OUT.

According to an exemplary embodiment, the first input terminal IN1 of the amplifier AMP may be supplied with a data voltage Vdata from the digital-to-analog converter of a corresponding channel by being coupled thereto, and the second input terminal IN2 of the amplifier AMP may receive the output voltage that is fed back thereto, that is, the data signal DSk, by being coupled to the output terminal OUT. In an exemplary embodiment, the first input terminal IN1 and the second input terminal IN2 may be an inverse input terminal and a non-inverse input terminal of the amplifier AMP, respectively, but the configurations thereof are not limited thereto.

According to an exemplary embodiment, the first power terminal P_IN1 of the amplifier AMP is coupled to the first switch SW1 of the switch unit 240, thereby being alternately supplied with power from the first driving power source VCC and the second driving power source VEE through the first switch SW1. Similarly, the second power terminal P_IN2 of the amplifier AMP is coupled to the second switch SW2 of the switch unit 240, thereby being alternately supplied with power from the first driving power source VCC and the second driving power source VEE through the second switch SW2.

According to an exemplary embodiment, the first and second power terminals P_IN1 and P_IN2 may be supplied with power from the first driving power source VCC and the second driving power source VEE in different orders. For example, while the first power terminal P_IN1 is being supplied with power from the first driving power source VCC, the second power terminal P_IN2 may be supplied with power from the second driving power source VEE, and while the first power terminal P_IN1 is being supplied with power from the second driving power source VEE, the second power terminal P_IN2 may be supplied with power from the first driving power source VCC.

The output terminal OUT of the amplifier AMP is coupled to the data line Dk. Accordingly, the data voltage Vdata, amplified by the amplifier AMP, may be output to each data line Dk as a data signal DSk.

The switch unit 240 alternately couples the first power terminal P_IN1 and the second power terminal P_IN2 of the amplifier AMP to the first driving power source VCC and the second driving power source VEE in response to a switch control signal CONT supplied from the driving controller 250. To this end, the switch unit 240 may include the first switch SW1 coupled to the first power terminal P_IN1 and the second switch SW2 coupled to the second power terminal P_IN2.

The first switch SW1 alternately couples the first power terminal P_IN1 of the amplifier AMP to the first driving power source VCC and the second driving power source VEE in response to a switch control signal CONT in the source output periods. For example, the first switch SW1 may repeatedly perform a power switching operation, through which the first power terminal P_IN1 of the amplifier AMP is alternately coupled to the first driving power source VCC and the second driving power source VEE, at every predetermined period in response to the switch control signal CONT during each source output period.

The second switch SW2 alternately couples the second power terminal P_IN2 of the amplifier AMP to the first driving power source VCC and the second driving power source VEE in reverse order to the first switch SW1 in response to the switch control signal CONT in the source output periods. For example, the second switch SW2 may repeatedly perform a power switching operation through which the second power terminal P_IN2 of the amplifier AMP is alternately coupled to the first driving power source VCC and the second driving power source VEE at every predetermined period in response to the switch control signal CONT during each source output period.

In an exemplary embodiment, the switch unit 240 may couple the first power terminals P_IN1 of at least some of the amplifiers AMP disposed in the respective channels of the output buffer unit 225 to one of the first driving power source VCC and the second driving power source VEE and couple the second power terminals P_IN2 of the at least some of the amplifiers AMP to the other one of the first driving power source VCC and the second driving power source VEE at every predetermined period.

For example, in an exemplary embodiment, the switch unit 240 may couple the first power terminals P_IN1 of the amplifiers AMP in the respective channels of the output buffer unit 225 to one of the first driving power source VCC and the second driving power source VEE and couple the second power terminals P_IN2 of the amplifiers AMP to the other one of the first driving power source VCC and the second driving power source VEE at every predetermined period.

Alternatively, in another exemplary embodiment, the switch unit 240 may couple the first power terminals P_IN1 of some of the amplifiers AMP in the respective channels of the output buffer unit 225, for example, the amplifiers AMP of the odd-numbered channels, to one of the first driving power source VCC and the second driving power source VEE and couple the second power terminals P_IN2 of the amplifiers AMP of the odd-numbered channels to the other one of the first driving power source VCC and the second driving power source VEE at every predetermined period. Also, the switch unit 240 may alternately couple the first power terminals P_IN1 and the second power terminals P_IN2 of the remaining amplifiers AMP of the respective channels of the output buffer unit 225, for example, the amplifiers AMP of the even-numbered channels, to the first driving power source VCC and the second driving power source VEE, respectively, in reverse order to the order in which the first and second power terminals of the amplifiers AMP of the odd-numbered channels are coupled.

Meanwhile, during each blank period, the power switching operation of the first switch SW1 and the second switch SW2 may be interrupted. For example, each of the first switch SW1 and the second switch SW2 may interrupt a power switching operation during each blank period in response to a switch control signal CONT and maintain the state in which the first and second switch SW1 and SW2 are coupled to different power sources, among the first driving power source VCC and the second driving power source VEE. Alternatively, each of the first switch SW1 and the second switch SW2 may maintain a turn-off state during a blank period in response to a switch control signal CONT.

That is, according to an exemplary embodiment of the present disclosure, the switch unit 240 may perform a power switching operation in accordance with source output periods and temporarily interrupt the power switching operation in accordance with blank periods in response to a switch control signal CONT. The switch control signal CONT is a control signal for controlling the power switching operation of the switch unit 240, and may be, for example, a switch enable signal (referred to as a "chopping enable signal") configured to enable the operations of the first and second switches SW1 and SW2 in accordance with the source output periods and to disable the operations of the first and second switches SW1 and SW2 in accordance with the blank periods.

Figure 5:
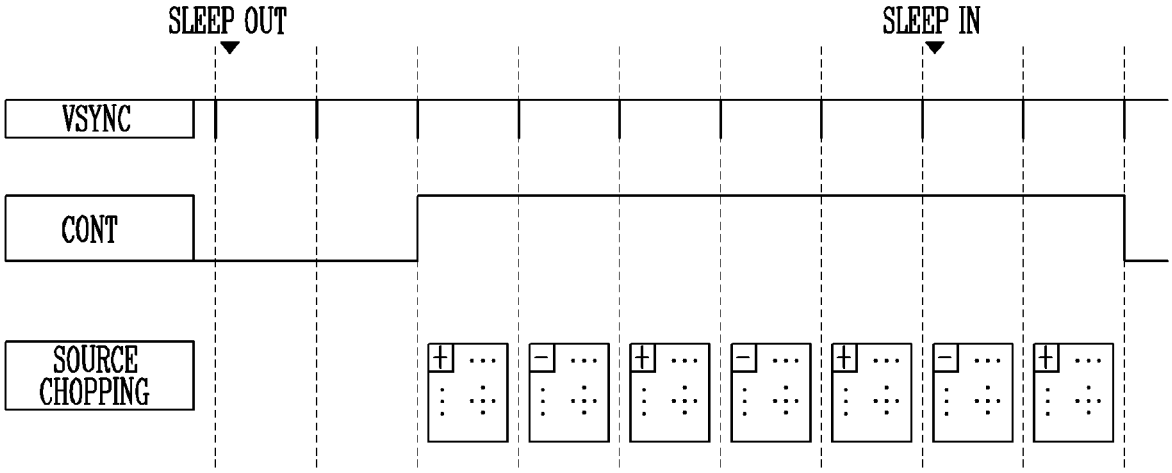
FIG. 5 schematically illustrates a power switching method according to an exemplary embodiment of the present disclosure.

FIG. 5 schematically illustrates a power switching method according to an exemplary embodiment of the present disclosure.

Referring to FIGS. 2, 3, 4, and 5, when a sleep-out instruction SLEEP OUT is transmitted from a host processor or the like to the driving controller 250, a switch control signal CONT for enabling the power switching operation (hereinafter, referred to as "source chopping") of the switch unit 240 is output from the driving controller 250 after a predetermined standby time has passed. The switch control signal CONT is transmitted to the switch unit 240.

For example, when the sleep-out instruction SLEEP OUT is input, the driving controller 250 may supply the switch unit 240 with a switch control signal CONT having an 'on' level, which enables source chopping after the preparation time for driving the data driver 220 (e.g., after a time period corresponding to about two frames). Accordingly, source chopping by the switch unit 240 commences.

According to an exemplary embodiment, source chopping may be performed at predetermined periods, and the period may be continually changed. For example, source chopping may be performed by alternately coupling each of the first and second switches SW1 and SW1 to the first driving power source VCC and the second driving power source VEE based on a frame period, a line period, or a column period, and the period at which the source chopping is performed may be changed at predetermined periods. As described above, when source chopping is performed by complexly applying a frame period, a line period, and/or a column period, a phenomenon in which a specific pattern is visible in the display area DA may be prevented or reduced.

Meanwhile, when a sleep-in instruction SLEEP IN is transmitted from a host processor or the like to the driving controller 250, a switch control signal CONT for disabling source chopping (e.g., a switch control signal having an 'off' level) is output from the driving controller 250 after a predetermined standby time (e.g., a period corresponding to about two frames) has passed. The switch control signal CONT is transmitted to the switch unit 240. Accordingly, source chopping by the switch unit 240 is interrupted.

FIG. 6 illustrates a switch controller 260 according to an exemplary embodiment of the present disclosure.

Referring to FIG. 6, the switch controller 260 according to an exemplary embodiment of the present disclosure is included in the driving controller 250, thereby generating a switch control signal CONT using a timing signal, which is input to the driving controller 250. According to an exemplary embodiment, the switch controller 260 may include a counter 261, a storage unit 262 (or a storage), and a control signal generator 263.

The counter 261 counts the timing signal input to the driving controller 250, thereby detecting each blank period. For example, the counter 261 may count a vertical synchronization signal VSYNC, a horizontal synchronization signal HSYNC, and/or a main clock signal MCLK and calculate each blank period depending on the counting result.

The storage unit 262 may store an option for the power switching operation of the switch unit 240 (hereinafter, referred to as a "source chopping option"). In an exemplary embodiment, the source chopping option may include at least one of the driving mode (e.g., a normal mode, a low-frequency mode, or a high-frequency mode) of the display device (e.g., the display device 10 of FIG. 1), information about whether a source chopping operation is enabled, and a period at which the source chopping operation is performed. For example, the storage unit 262 may store a value that is set for at least one of the driving mode of the display device 10, the information about whether the source chopping operation is enabled, and the period at which the source chopping operation is performed.

Also, the source chopping option may further include at least one of information about whether a power switching operation is enabled in a blank period and information about a time section during which the source chopping operation is interrupted, the time section corresponding to the blank period. For example, the storage unit 262 may store a value set for the information about whether to enable a power switching operation in a blank period and values set for the start point and the end point of the time section during which the source chopping operation is required to be actually interrupted in response to each blank period. That is, according to an exemplary embodiment, the start point and the end point of the time section during which source chopping is interrupted in response to each blank period are additionally set, whereby the time section during which source chopping is actually interrupted in response to the blank period may be more freely controlled.

The control signal generator 263 generates a switch control signal CONT based on the blank period detected by the counter 261 and on the source chopping option extracted from the storage unit 262. For example, when an instruction to enable source chopping is input from a host processor or the like, the control signal generator 263 may generate a switch control signal CONT that enables source chopping in the respective source output periods but temporarily interrupts source chopping in the respective blank periods, each of which is inserted between the source output periods.

Also, based on the information input from the host processor or the like, the control signal generator 263 may detect the driving mode of the display device 10 and/or the period at which source chopping is performed and generate a switch control signal CONT corresponding thereto. For example, the control signal generator 263 may extract the source chopping option, corresponding to the instruction input from a host processor, from the storage unit 262 and generate a switch control signal CONT depending on the extracted source chopping option.

FIG. 7 and FIG. 8 illustrate examples of the source chopping option stored in the storage unit 262 of FIG. 6. For example, FIG. 7 and FIG. 8 illustrate various options applicable to source shopping performed by the switch unit 240.

First, referring to FIGS. 1, 2, 3, 4, 5, 6, and 7, the storage unit 262 may store information about the driving mode of the display device 10, whether a source chopping operation is enabled, and the period at which the source chopping operation is performed. For example, the storage unit 262 may store values set for a source amp chopping timing control register in a normal mode, in a low-frequency mode, and in a high-frequency mode (CHOP_CON_NOM, CHOP_ CON_LFM, and CHOP_CON_HFM), a value set for a source chopping on/off signal (CHOP_EN), a value set for a source amp column chopping control signal (COLUM_CHOP), a value set for a source amp frame chopping control signal (FRAME_CHOP), and a value set for a source amp line chopping control signal (LINE_ CHOP).

Referring to FIG. 8, the storage unit 262 may further store information about whether a power switching operation is enabled in a blank period (or a blank section corresponding thereto). For example, the storage unit 262 may further store a value set for a source amp chopping on/off signal in a blank section (CHOP_BLK_EN).

Also, in order to more freely control the time at which source chopping is interrupted in response to each blank period, the storage unit 262 may further store information about the time section during which source chopping operation is interrupted, the time section corresponding to the blank period. For example, the storage unit 262 may further store values for setting the start point of interruption of source chopping (that is, the start point of source chopping off) and the end point thereof in each blank section (or sections before and after the blank section) (CHOP_ BLK_OFF_ST and CHOP_BLK_OFF_END). In an exemplary embodiment, the time point immediately before entering each blank section may be set as the start point of interruption of source chopping, and the time point immediately before the finish of each blank section may be set as the end point of interruption of source chopping, but the start point and the end point of interruption of source chopping are not limited to this example. That is, the start point and the end point of interruption of source chopping may be variously changed according to an exemplary embodiment.

As in the exemplary embodiment of FIG. 8, when the options related to interruption of source chopping in a blank section are additionally stored, source chopping may be temporarily interrupted during each blank period. For example, even during the period in which source chopping is actually enabled, source chopping may be temporarily interrupted during each blank period.

According to the above-described embodiment, in the period in which respective data signals DS1 to DSm are output from the data driver 220, the voltage deviation of the data signals DS1 to DSm is reduced through source chopping, but source chopping may be selectively interrupted in each blank period in which source chopping is unnecessary. When the sensor unit 300 is driven in such a blank period, the noise of the sensor unit 300 (e.g., touch noise) generated by source chopping may be prevented or reduced.

Figure 9:
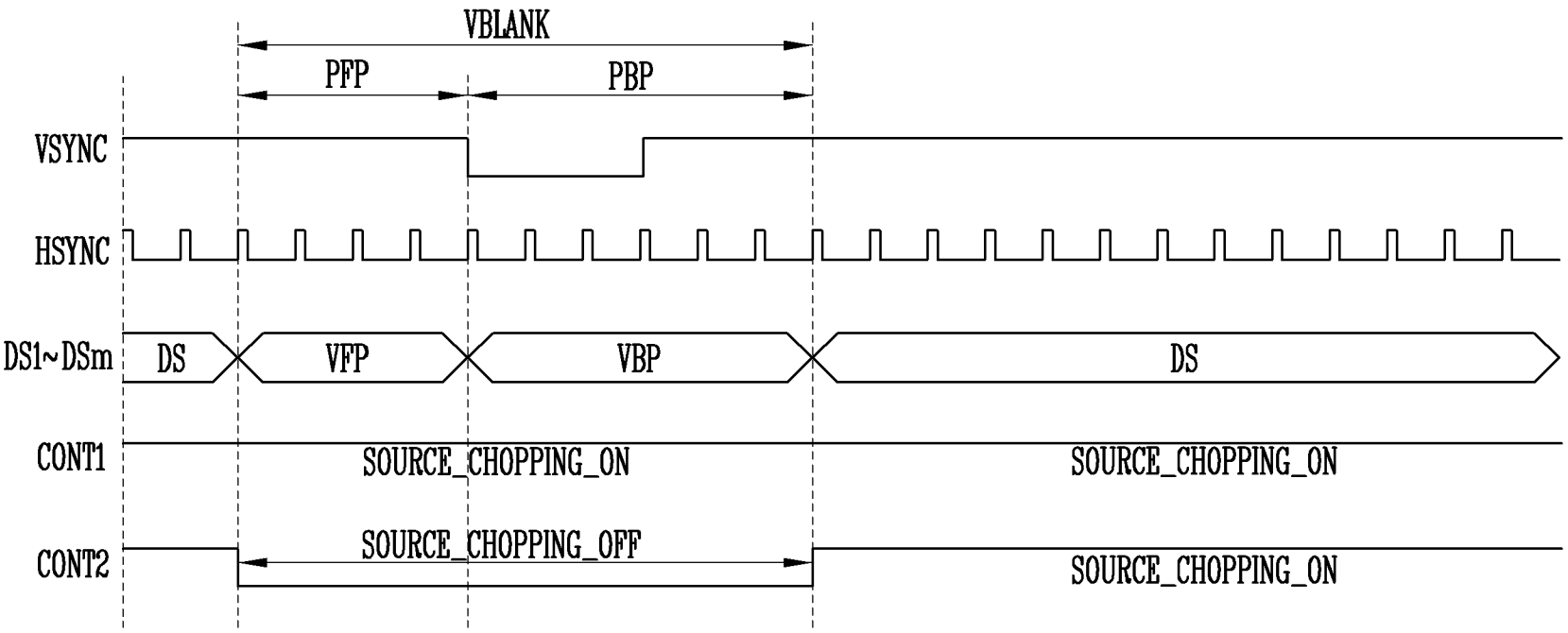
FIG. 9 illustrates a first switch control signal and a second switch control signal according to different exemplary embodiments of the present disclosure.

FIG. 9 illustrates a first switch control signal CONT1 and a second switch control signal CONT2 according to different exemplary embodiments of the present disclosure. For example, the first switch control signal CONT1 may be a switch control signal that is generated in the exemplary embodiment in which source chopping is maintained during a period in which the display driver 200 is driven by applying a source chopping method. Also, the second switch control signal CONT2 may be a switch control signal that is generated in the exemplary embodiment in which the display driver 200 is driven by applying the source chopping method but source chopping is interrupted in each blank period.

Referring to FIG. 9, each blank period VBLANK includes a period in which each vertical synchronization signal VSYNC is supplied, and may further include predetermined periods arranged before and after the vertical synchronization signal VSYNC is supplied. For example, each blank period VBLANK may include a front porch period PFP and a back porch period PBP that are successively arranged between the source output periods in which the data signals DS of each frame are output. According to an exemplary embodiment, the front porch period PFP may be arranged immediately after the source output period of each frame, and the back porch period may be arranged immediately before the source output period of the next frame. Each vertical synchronization signal VSYNC may be supplied in each back porch period.

According to an exemplary embodiment, the data driver 220 may output a predetermined front porch voltage VFP during the front porch period and output a predetermined back porch voltage VBP during the back porch period. The front porch voltage VFP and the back porch voltage VBP may be black grayscale voltages, but are not limited thereto.

In an exemplary embodiment, a first switch control signal CONT1, through which source chopping is consistently maintained during the period in which the display driver 200 is driven by applying a source chopping method, may be generated. Also, using the first switch control signal CONT1, source chopping by the switch unit 240 may be controlled so as to be consistently performed during the period in which the display driver 200 is enabled.

In another exemplary embodiment, a second switch control signal CONT2, through which the display driver 200 is driven by applying the source chopping method but source chopping is interrupted in each blank period VBLAK (e.g., a source chopping operation is temporarily interrupted), may be generated. Also, using the second switch control signal CONT2, source chopping by the switch unit 240 may be controlled so as to be performed only in the source output periods but to be interrupted in each blank period VBLANK over the period in which the display driver 200 is enabled.

That is, in the exemplary embodiment of the present disclosure, source chopping by the switch unit 240 may be easily controlled using a switch control signal CONT such as the first switch control signal CONT1, the second switch control signal CONT2, and the like.

The method of driving the display device 10 according to the exemplary embodiments described with reference to FIGS. 1, 2, 3, 4, 5, 6, 7, 8, and 9 may include generating a switch control signal CONT in response to a timing signal and outputting a data signal DS of each frame while alternately coupling the first power terminal P_IN1 and the second power terminal P_IN2 of each amplifier AMP disposed at the output terminal of the data driver 220 (e.g., the output buffer unit 225) to the first driving power source VCC and the second driving power source VEE in response to the switch control signal CONT. According to an exemplary embodiment, during the source output periods in which the data signal DS of each frame is output, a source chopping operation, through which the first and second power terminals P_IN1 and P_IN2 of the amplifier AMP are alternately coupled to the first and second driving power sources VCC and VEE, may be repeatedly performed. Also, according to an exemplary embodiment, the source chopping operation may be selectively interrupted during each blank period arranged between the source output periods.

Figure 10:
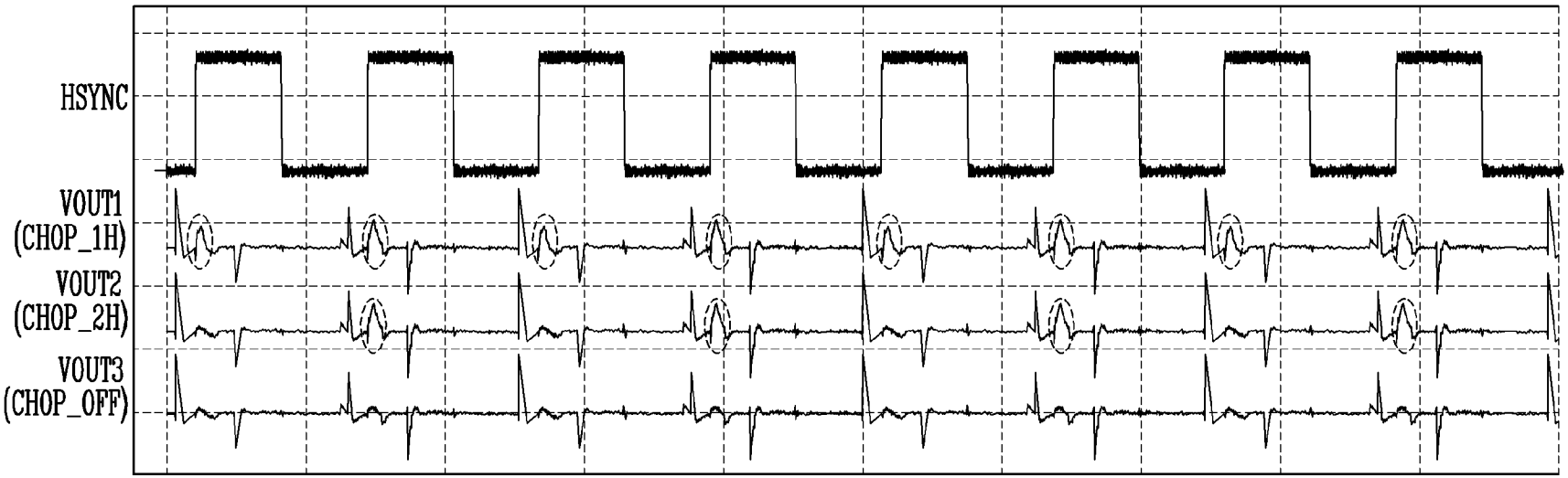
FIG. 10 illustrates the output voltage of a data driver depending on source chopping.

FIG. 10 illustrates the output voltages VOUT1, VOUT2, and VOUT3 of the data driver 220 according to source chopping. For example, FIG. 10 illustrates the result of measuring the output voltages of the data driver 220 when source chopping is performed respectively at intervals of a first horizontal period 1H and at intervals of a second horizontal period 2H (hereinafter, referred to as a "first output voltage (VOUT1)" and a "second output voltage (VOUT2)") and the result of measuring the output voltage of the data driver 220 when source chopping is interrupted (hereinafter, referred to as a "third output voltage VOUT3").

Referring to FIG. 10, the form of noise in the output voltages VOUT1, VOUT2 and VOUT3 of the data driver 220 varies depending on whether source chopping is performed and the period at which source chopping is performed. For example, when source chopping is performed at intervals of a first horizontal period 1H, noise in the first output voltage VOUT1 appears in every first horizontal period 1H. When source chopping is performed at intervals of a second horizontal period 2H, noise in the second output voltage VOUT2 appears in every second horizontal period 2H. However, when source chopping is interrupted, no noise is actually generated in the third output voltage VOUT3. That is, source chopping may cause the output voltages VOUT1, VOUT2 and VOUT3 of the data driver 220 to vary.

In this case, the voltages of the data lines D1 to Dm vary, whereby noise caused by source chopping may be generated. According to an exemplary embodiment, in the display device 10 including the sensor unit 300 that overlaps the display unit 100 as illustrated in FIG. 1, noise in the output voltages VOUT1, VOUT2 and VOUT3 of the data driver 220 may flow in the sensor unit 300.

However, when source chopping is temporarily interrupted during each blank period VBLAK and the sensor unit 300 is driven during the blank period VBLANK as described in the above embodiment, the voltage variation of sensor electrodes SE caused by source chopping may be prevented. Accordingly, the noise of the sensor unit 300 may be effectively reduced or prevented.

That is, according to an exemplary embodiment of the present disclosure, the offset of an amplifier AMP is cancelled out through source chopping, whereby the voltage deviation of a data signal DS may be reduced and a source chopping period may be efficiently adjusted using a switch control signal CONT. For example, source chopping is interrupted during each blank period, and the sensor unit 300 is driven during the blank period, whereby the noise of the sensor unit 300 may be effectively reduced.

The display device and the method of driving the display device in accordance with an exemplary embodiment of the present disclosure enable the offset of an amplifier to be cancelled out through power switching, thereby reducing the voltage deviation of a data signal. Also, a power switching period is controlled using a switch control signal such that a power switching operation is interrupted during each blank period, whereby the noise of a sensor unit may be reduced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display unit comprising pixels coupled to scan lines and data lines;

a scan driver configured to supply respective scan signals to the scan lines;

a data driver configured to supply respective data signals to the data lines, the data driver comprising an amplifier disposed at an output terminal of the data driver, the amplifier comprising a first power terminal and a second power terminal;

a switch unit configured to perform a power switching operation of alternately connecting the first power terminal and the second power terminal of the amplifier to a first driving power source and a second driving power source during source output periods; and a driving controller configured to control the scan driver, the data driver, and the switch unit in response to input image data and a timing signal, wherein the driving controller is configured to output a switch control signal to control the switch unit, wherein the switch unit is configured to interrupt the power switching operation in response to receiving the switch control signal during a blank period, the blank period being arranged between the source output periods, wherein the data driver is configured to output the data signals of each frame during the source output periods, and wherein the switch unit is configured to alternately connect the first power terminal of the amplifier to the first driving power source and the second driving power source during the source output periods and to alternately connect the second power terminal of the amplifier to the first driving power source and the second driving power source in an order inverse to the first power terminal of the amplifier during the source output periods.

2. The display device according to claim 1, wherein the driving controller is configured to control the switch unit to perform the power switching operation during the source output periods.

3. The display device according to claim 2, wherein the switch unit comprises:

a first switch configured to alternately connect the first power terminal of the amplifier to the first driving power source and the second driving power source in response to the switch control signal in the source output periods; and a second switch configured to alternately connect the second power terminal of the amplifier to the first driving power source and the second driving power source in an order inverse to the first switch in response to the switch control signal in the source output periods.

4. The display device according to claim 3, wherein, in response to the switch control signal, the first switch and the second switch are configured to repeatedly perform the power switching operation at every predetermined period during the source output periods.

5. The display device according to claim 3, wherein, in response to the switch control signal, the first switch and the second switch are configured to interrupt the power switching operation or maintain a turn-off state during the blank period.

6. The display device according to claim 2, wherein the driving controller comprises a switch controller configured to generate the switch control signal using the timing signal.

7. The display device according to claim 6, wherein the switch controller comprises:

a counter configured to detect the blank period by counting the timing signal;

a storage unit configured to store an option for the power switching operation of the switch unit; and a control signal generator configured to generate the switch control signal based on the blank period detected by the counter, and the option for the power switching operation extracted from the storage unit.

8. The display device according to claim 7, wherein the option for the power switching operation comprises at least one of a driving mode of the display device, a power switching operation mode, and a period of the power switching operation.

9. The display device according to claim 8, wherein the option for the power switching operation further comprises at least one of a power switching operation mode during the blank period and information about a section of the blank period during which the power switching operation is interrupted.

10. The display device according to claim 1, wherein the blank period comprises a front porch period and a back porch period that are successively arranged between the source output periods.

11. The display device according to claim 1, wherein the data driver comprises amplifiers disposed in respective output channels coupled to the respective data lines, and wherein the switch unit is configured to:

connect first power terminals of at least one of the amplifiers to one of the first and second driving power sources for a first predetermined time period; and connect second power terminals of the at least one of the amplifiers to a remaining one of the first and second driving power sources for a second predetermined time period.

12. The display device according to claim 1, further comprising a sensor unit that overlaps the display unit, wherein the driving controller is configured to drive the sensor unit during the blank period.

13. A method of driving a display device, comprising:

generating a switch control signal in response to a timing signal; and outputting a data signal of each frame;

performing, while outputting the data signal, a power switching operation by alternately switching connections from a first power terminal and a second power terminal of an amplifier disposed at an output terminal of a data driver, to a first driving power source and a second driving power source in response to the switch control signal during source output periods, wherein the power switching operation is repeatedly performed during the source output periods, the source output periods referring to time frame in which the data signal of each frame is output, wherein the power switching operation is interrupted during a blank period, the blank period arranged between the source output periods, and wherein performing, while outputting the data signal, the power switching operation comprises:

alternately connecting the first power terminal of the amplifier to the first driving power source and the second driving power source during the source output periods, and alternately connecting the second power terminal of the amplifier to the first driving power source and the second driving power source in an order inverse to the first power terminal of the amplifier during the source output periods.

14. The method according to claim 13, wherein generating the switch control signal comprises:

detecting the blank period based on the timing signal; and generating the switch control signal based on the blank period and a power switching operation option that is pre-stored.

15. The method according to claim 14, wherein the power switching operation option comprises at least one of a driving mode of the display device, a power switching operation mode, and a period at which the power switching operation is performed.

16. The method according to claim 15, wherein the power switching operation option further comprises at least one of a power switching operation mode during the blank period and information about a section of the blank period during which the power switching operation is interrupted.

* * * * *